US011619082B2

(12) United States Patent
Williams et al.

(10) Patent No.: US 11,619,082 B2
(45) Date of Patent: Apr. 4, 2023

(54) MONOPOLE DOOR HINGES AND ASSEMBLIES

(71) Applicant: CommScope Technologies LLC, Hickory, NC (US)

(72) Inventors: Richard D. Williams, Wylie, TX (US); Kevin L. Rovell, Arlington, TX (US); Jignesh Patel, Plano, TX (US); Ulrich Gienger, Fairview, TX (US)

(73) Assignee: CommScope Technologies LLC, Hickory, NC (US)

( * ) Notice: Subject to any disclaimer, the term of this patent is extended or adjusted under 35 U.S.C. 154(b) by 365 days.

(21) Appl. No.: 16/885,974

(22) Filed: May 28, 2020

(65) Prior Publication Data

US 2020/0378164 A1 Dec. 3, 2020

Related U.S. Application Data

(60) Provisional application No. 62/853,989, filed on May 29, 2019.

(51) Int. Cl.

| | |
|---|---|
| ***E05D 3/02*** | (2006.01) |
| ***E05D 5/06*** | (2006.01) |
| ***E04H 12/00*** | (2006.01) |
| ***E04H 12/08*** | (2006.01) |
| ***H01Q 1/12*** | (2006.01) |

(52) U.S. Cl.

CPC ..... *E05D 3/02* (2013.01); *E04H 12/003* (2013.01); *E04H 12/08* (2013.01); *E05D 5/06* (2013.01); *H01Q 1/1242* (2013.01); *E05D 2005/067* (2013.01); *E05Y 2600/54* (2013.01); *E05Y 2800/676* (2013.01); *E05Y 2900/60* (2013.01)

(58) Field of Classification Search

CPC .... E05D 3/02; E05D 5/06; E05D 7/00; E05D 2005/067; E04H 12/003; E04H 12/08; H01Q 1/1242; Y10T 16/5595; Y10T 16/558

See application file for complete search history.

(56) References Cited

U.S. PATENT DOCUMENTS 1,145,766 A * 7/1915 Hall ..... B65D 90/54 52/186
1,169,669 A * 1/1916 Mitchell ..... E05F 1/068 16/311
1,265,966 A * 5/1918 Schlafly ..... B65D 90/08 52/630

(Continued)

*Primary Examiner* — Gisele D Ford
(74) *Attorney, Agent, or Firm* — Myers Bigel, P.A.

(57) ABSTRACT

The present disclosure describes a monopole door hinge assembly. The assembly may comprise a monopole comprising a door, the monopole and door both having an interior surface, and a plurality of hinges. Each hinge may comprise a base member configured to be secured to the interior surface of the monopole; and a rib member having a supporting portion and a mounting portion, the supporting portion having an arcuate profile that corresponds to an arcuate profile of the interior surface of the door and the mounting portion is pivotably attached to the base member. The base member of each hinge is mounted to the interior surface of the monopole and the supporting portion of each hinge is mounted to the interior surface of the door, thereby securing the door to the monopole.

16 Claims, 9 Drawing Sheets

(56) References Cited

U.S. PATENT DOCUMENTS 1,331,770 A * 2/1920 Hulen ..... B65D 90/54 49/253
3,004,303 A * 10/1961 Wilmer ..... B64C 1/14 49/249
3,550,637 A * 12/1970 Briden ..... F16L 45/00 138/92
3,628,216 A * 12/1971 Saveli ..... E05D 3/10 16/367
3,791,073 A * 2/1974 Baker ..... B64C 1/1407 49/40
3,987,596 A * 10/1976 Wolf ..... B65D 90/54 49/40
4,271,632 A * 6/1981 Vanderloop ..... E05D 15/52 52/192
4,376,360 A * 3/1983 Hanson ..... B65D 90/10 52/196
4,480,408 A * 11/1984 Deuman, Sr. ..... E05D 15/58 52/192
4,720,065 A * 1/1988 Hamatani ..... B64C 1/143 244/905
5,180,121 A * 1/1993 Banks ..... E05F 15/54 49/237
5,305,969 A * 4/1994 Odell ..... B64C 1/1407 292/259 R
5,337,977 A * 8/1994 Fleming ..... B64C 1/143 D12/345
5,455,987 A * 10/1995 Svehaug ..... E05F 1/063 16/385
5,483,019 A * 1/1996 Tourigny ..... H02G 3/14 174/45 R
5,524,411 A * 6/1996 Crossman ..... E04H 12/003 174/45 R
5,868,355 A * 2/1999 Carter, Jr. ..... B63B 19/08 244/129.5
6,470,645 B1 * 10/2002 Maliszewski ..... F03D 13/10 52/745.18
6,655,634 B2 * 12/2003 Erben ..... B64C 1/1407 49/246
6,688,806 B2 * 2/2004 Kuan ..... E02D 29/1409 404/26
7,157,642 B2 * 1/2007 Bowman ..... E04H 12/003 174/45 R
7,774,986 B2 * 8/2010 Unterreiner ..... B60J 5/0416 49/502
7,856,759 B2 * 12/2010 Elliott ..... E05D 15/58 49/358
7,950,719 B2 * 5/2011 Elliott ..... B60J 5/06 296/155
8,109,061 B2 * 2/2012 Kristensen ..... E04H 12/003 52/843
8,171,674 B2 * 5/2012 Bagepalli ..... F03D 13/20 52/651.01
8,752,337 B2 * 6/2014 Kristensen ..... F03D 13/20 52/651.07
8,919,698 B2 * 12/2014 Kim ..... E05D 3/12 244/129.5
9,253,556 B1 * 2/2016 Pounds ..... G10K 11/16
9,279,266 B2 * 3/2016 Unanua Hermoso De Mendoza ..... F03D 80/50
9,427,827 B2 * 8/2016 Savolainen ..... B23K 28/02
9,433,034 B2 * 8/2016 Hendrix ..... H01Q 1/36
9,515,460 B1 * 12/2016 Moghal ..... E04H 12/003
9,541,059 B2 * 1/2017 Kristensen ..... F03D 80/00
9,630,700 B2 * 4/2017 Kammerer ..... B64C 1/1407
9,834,979 B2 * 12/2017 Ge ..... E05C 19/14
10,411,336 B1 * 9/2019 Schwartz ..... H01Q 1/12
10,947,751 B2 * 3/2021 Lockwood ..... E04H 12/02
11,067,468 B2 * 7/2021 Berkey ..... B64C 1/143
2002/0139897 A1 * 10/2002 Erben ..... B64C 1/1407 244/129.5
2003/0038500 A1 * 2/2003 Aubry ..... E05F 15/619 296/76
2006/0102664 A1 * 5/2006 Brashears ..... B65G 67/06 222/608
2006/0185874 A1 * 8/2006 Bowman ..... E04H 12/003 174/45 R
2006/0279105 A1 * 12/2006 Renke ..... E05F 5/06 296/146.11
2008/0034675 A1 * 2/2008 Kristensen ..... F03D 80/00 52/745.18
2011/0219711 A1 * 9/2011 Bagepalli ..... E04H 12/003 52/651.01
2011/0265402 A1 * 11/2011 Pfleger ..... F03D 13/20 52/213
2012/0000304 A1 * 1/2012 Hamminga ..... E05F 15/41 74/89.23
2013/0219659 A1 * 8/2013 Oshima ..... E05D 7/0407 16/236
2013/0234573 A1 * 9/2013 Coxon ..... E05D 5/06 312/228
2014/0115826 A1 * 5/2014 Nuckolls ..... E05D 5/02 16/386
2015/0052846 A1 * 2/2015 Gonz Lez Del Egido ..... F03D 80/00 52/651.01
2015/0071790 A1 * 3/2015 Tieke ..... F03D 13/10 212/230
2015/0089901 A1 * 4/2015 Chan ..... E04H 12/003 52/848
2015/0107179 A1 * 4/2015 Unanua Hermoso De Mendoza ..... F03D 80/50 52/651.01
2017/0214113 A1 * 7/2017 Norrell ..... H01Q 1/44
2018/0134366 A1 * 5/2018 Merkel ..... B64G 1/60
2018/0254545 A1 * 9/2018 Hendrix ..... H01Q 1/02
2019/0221913 A1 * 7/2019 Castronova ..... H01Q 1/44
2020/0136236 A1 * 4/2020 Colapietro ..... H01Q 21/0025
2020/0388907 A1 * 12/2020 Colapietro ..... H01Q 1/1242
2021/0320393 A1 * 10/2021 Williams ..... H01Q 1/1221

* cited by examiner

MONOPOLE DOOR HINGES AND ASSEMBLIES

RELATED APPLICATION(S)

The present application claims priority from and the benefit of U.S. Provisional Patent Application Ser. No. 62/853,989, filed May 29, 2019, the disclosure of which is hereby incorporated herein in its entirety.

FIELD

The present application is directed generally toward telecommunications equipment and more particularly, hinges and assemblies for doors for monopoles that support antennas.

BACKGROUND

In some designs, monopoles 10 for antennas have doors 12 that provide access to a technician to the internal components of the antenna system (see, e.g., FIG. 1A). However, the hinges 20 that are currently used to secure the doors 12 to the monopole 10 may encounter a number of problems. For example, many of these hinges 20 are not able to sufficiently support the weight of the doors 12 (see, e.g., FIG. 1B). This can lead to bending or other damage to the door 12 and/or monopole 10, including damage to the outer finish of the monopole 10 (see, e.g., FIG. 1C). There may be a need for monopole door hinges that provide sturdy construction and permit easy installation, while alleviating these known problems.

SUMMARY

An aspect of the present invention is directed to a monopole door hinge assembly. The assembly may comprise a monopole comprising a door, the monopole and door both having an interior surface, and a plurality of hinges. Each hinge may comprise a base member configured to be secured to the interior surface of the monopole; and a rib member having a supporting portion and a mounting portion, the supporting portion having an arcuate profile that corresponds to an arcuate profile of the interior surface of the door and the mounting portion is pivotably attached to the base member. The base member of each hinge is mounted to the interior surface of the monopole and the supporting portion of each hinge is mounted to the interior surface of the door, thereby securing the door to the monopole.

Another aspect of the present invention is directed to a hinge for a door of a monopole. The hinge may comprise a base member configured to be secured to an interior surface of the monopole; and a rib member having a supporting portion and a mounting portion, the supporting portion having an arcuate profile that corresponds to an arcuate profile of an interior surface of the door of the monopole and the mounting portion is pivotably attached to the base member.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim and/or file any new claim accordingly, including the right to be able to amend any originally filed claim to depend from and/or incorporate any feature of any other claim or claims although not originally claimed in that manner. These and other objects and/or aspects of the present invention are explained in detail in the specification set forth below. Further features, advantages and details of the present invention will be appreciated by those of ordinary skill in the art from a reading of the figures and the detailed description of the preferred embodiments that follow, such description being merely illustrative of the present invention.

DETAILED DESCRIPTION

Figure 1A:
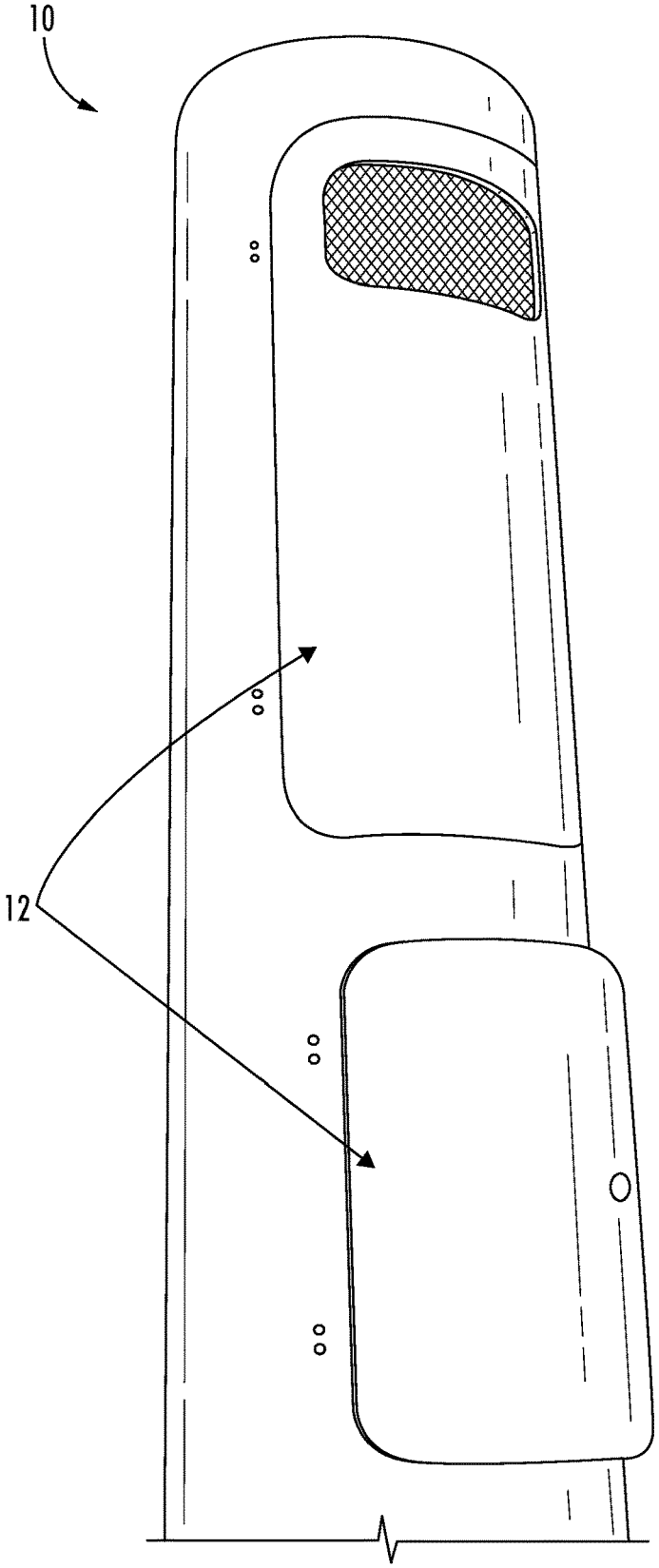
FIG. 1A (PRIOR ART)
FIG. 1A is a photograph of a prior art monopole with two access doors.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

The present invention now will be described more fully hereinafter with reference to the accompanying drawings, in which illustrative embodiments of the invention are shown.

In the figures, certain layers, components or features may be exaggerated for clarity, and broken lines illustrate optional features or operations unless specified otherwise. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention. The sequence of operations (or steps) is not limited to the order presented in the claims or figures unless specifically indicated otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Figure 1B:
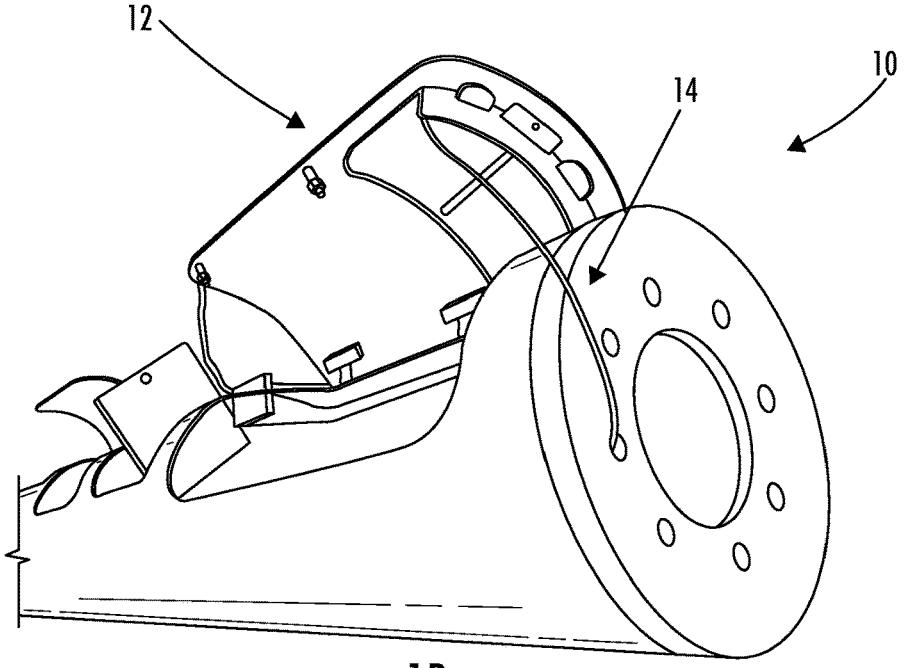
FIG. 1B (PRIOR ART)
FIG. 1B is a photograph of a prior art monopole door shown in an open position.
Figure 1C:
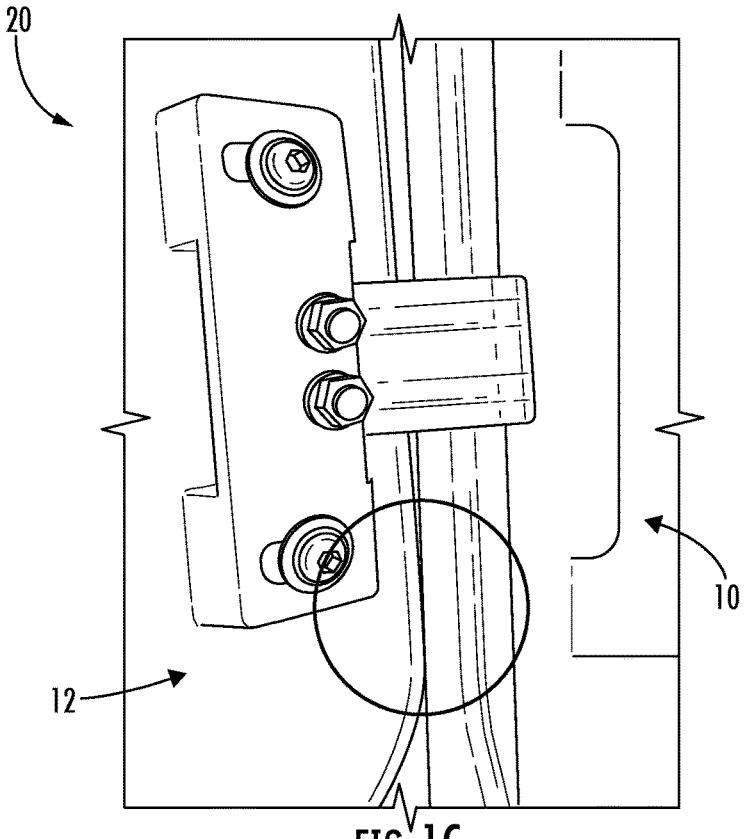
FIG. 1C (PRIOR ART)
FIG. 1C is a photograph of a prior art hinge for the monopole door of FIG. 1B.

Embodiments of the present invention will now be discussed in greater detail with reference to the drawings. Referring to FIGS. 2-8, a monopole door hinge assembly 100 is illustrated. Similar to the known monopole door assemblies shown in FIGS. 1A-1C, a monopole door hinge assembly 100 of the present invention may comprise a monopole 10 having an interior surface 10*i* and an exterior surface 10*e*. The monopole 10 may comprise one or more doors 12, each door 12 having a width W, a length L, an interior surface 12*i*, and an exterior surface 12*e*.

Figure 2:
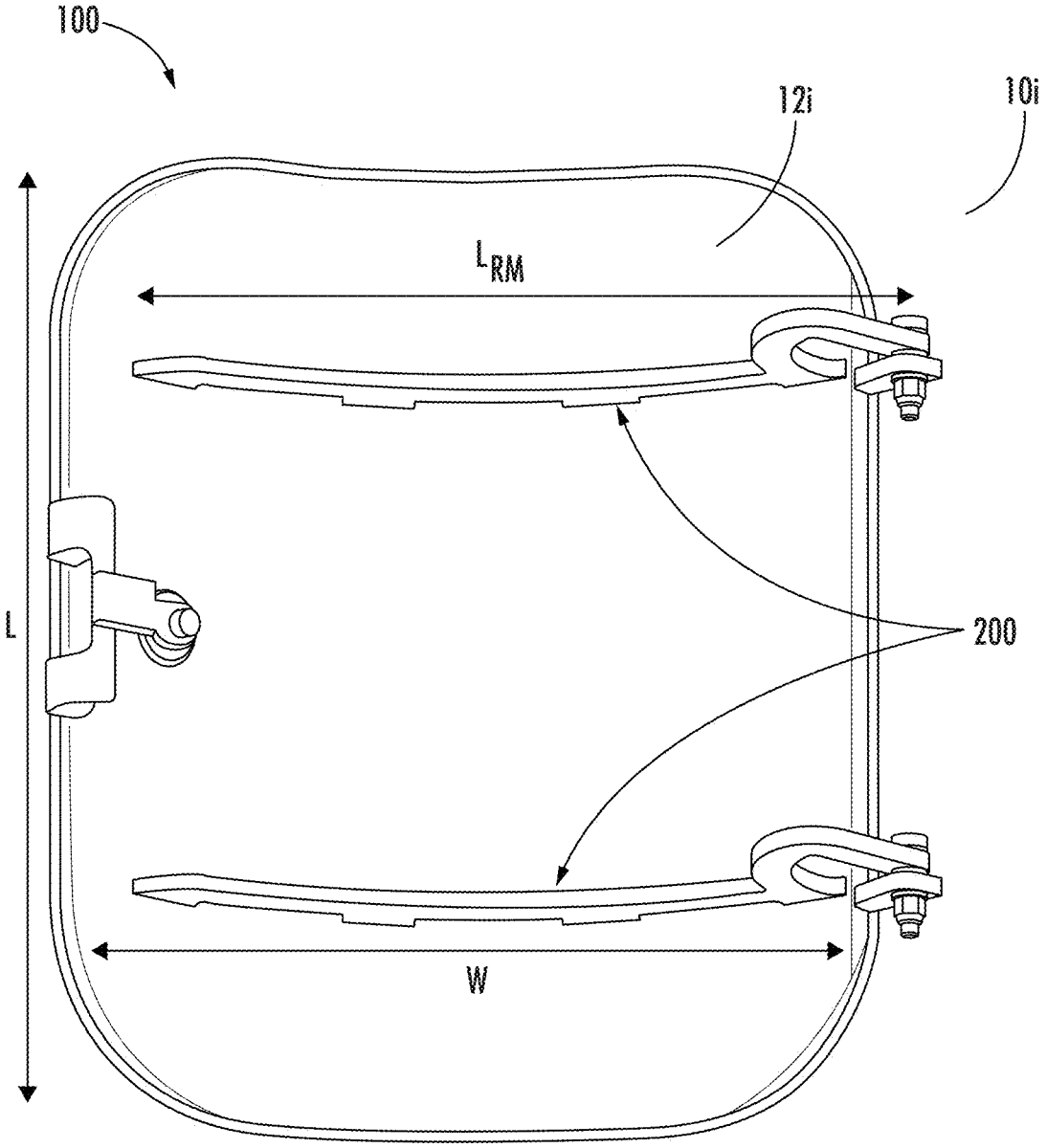
FIG. 2 is a rear view of a monopole door hinge assembly according to embodiments of the present invention.

As shown in FIG. 2, the monopole door hinge assembly 100 of the present invention may further comprise a plurality of hinges 200. As discussed in further detail below, the hinges 200 allow a door 12 to which they are attached to pivot between a closed position and an open position. The ability to pivot helps to provide relatively easy access to the internal components of the monopole 10 by a technician.

Figure 3A:
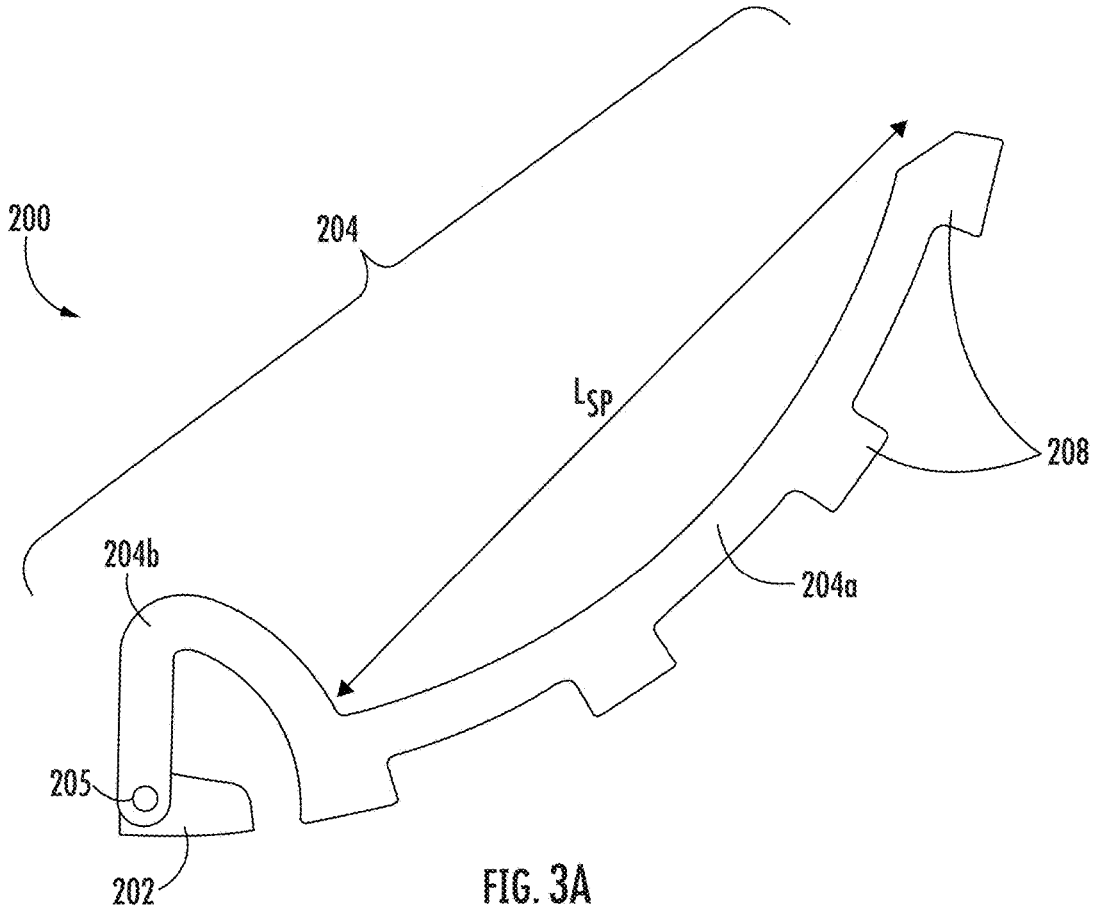
FIG. 3A is a top view of one of the hinges of FIG. 2.
Figure 3B:
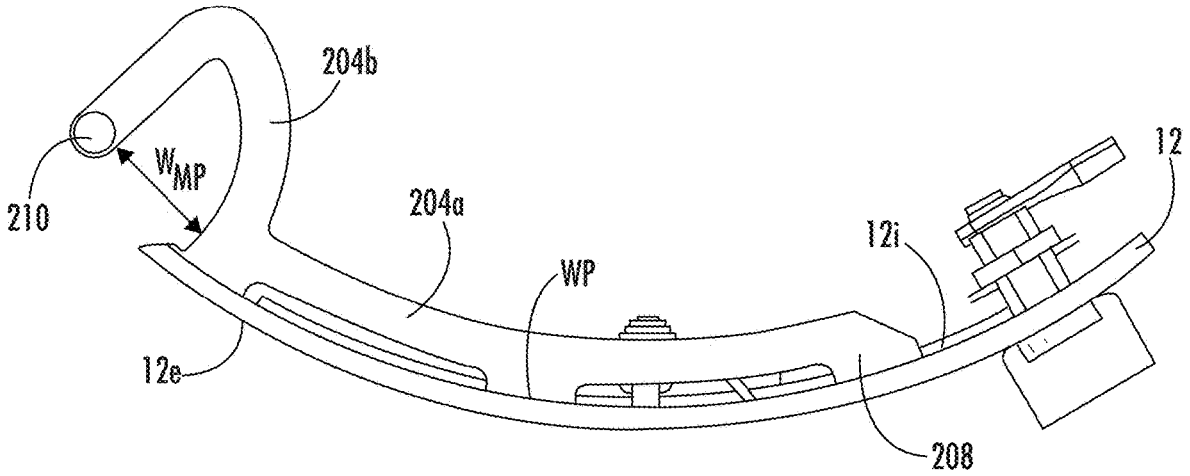
FIG. 3B is a top view of the hinge of FIG. 3A mounted to a monopole door.

Referring now to FIGS. 3A and 3B, a hinge 200 according to embodiments of the present invention is illustrated. FIG. 3A is a top view of the hinge 200 by itself and FIG. 3B is a top view of the hinge 200 secured to a door 12 of a monopole 10 as part of the monopole door hinge assembly 100.

As shown in FIGS. 3A and 3B, each hinge 200 includes a base member 202 and a rib member 204. The base member 202 and the rib member 204 have a length ($L_{BM}$, $L_{RM}$) (see, e.g., FIGS. 2 and 4) and a thickness ($T_{BM}$, $T_{RM}$), respectively (see also, e.g., FIGS. 4 and 5). The thickness of the base member 202 and rib member 204 of each hinge 200 are substantially equal in thickness ($T_{BM}$, $T_{RM}$). In some embodiments, the thickness ($T_{BM}$, $T_{RM}$) of each hinge 200 is in the range of about 0.125 inches to about 0.375 inches. For example, in some embodiments the thickness ($T_{BM}$, $T_{RM}$) of each hinge is 0.25 inches. The hinges 200 are made from a material having sufficient strength to support the weight of a monopole door 12. For example, in some embodiments, the hinges 200 are formed from steel or a like material.

Figure 4:
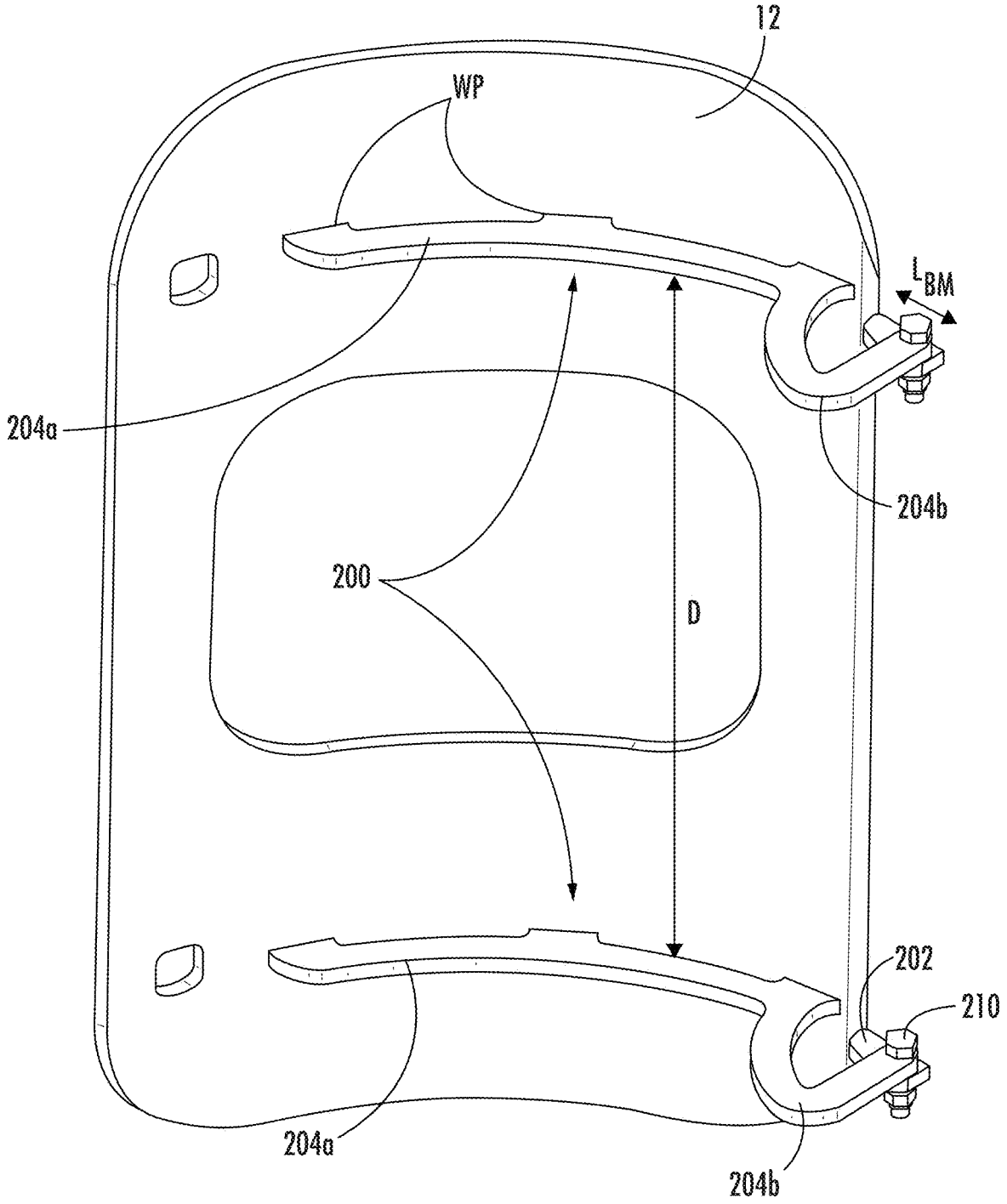
FIG. 4 is a rear perspective view of the plurality of hinges of FIG. 2 mounted to a monopole door.

The base member 202 provides a point to secure the hinge 200 to the interior surface 10*i* of the monopole 10 (see also, e.g., FIG. 5) and the rib member 204 provides one or more points to secure the hinge 200 to the door 12 (see, e.g., FIGS. 3A and 4). For example, in some embodiments, the base member 202 may be configured to be mounted to the interior surface 10*i* of the monopole 10. In some embodiments, the base member 202 may be mounted to the interior surface 10*i* of the monopole 10 via welding.

Still referring to FIGS. 3A and 3B, in some embodiments, the rib member 204 of each hinge 200 includes a supporting portion 204*a* and a mounting portion 204*b*. In some embodiments, the supporting portion 204*a* of the rim member 204 may have a length $L_{SP}$ that extends a substantial width W of the door 12. For example, in some embodiments, the supporting portion 204*a* has a length $L_{SP}$ in the range of about 8 inches to about 14 inches. The rim member 204 may be mounted to the interior surface 12*i* of the door 12, for example, via welding.

The supporting portion 204*a* of the rim member 204 has an arcuate or curved profile. In some embodiments, the profile of the supporting portion 204*a* of the hinge 200 corresponds to the profile of the interior surface 12*i* of the door 12 (see, e.g., FIG. 3B). Matching the profile of the hinge 200 to correspond with the profile of the door 12 helps to maintain the natural curvature/shape of the door 12 when the hinge 200 is mounted to the door 12. Also, the rib member 204 is typically of sufficient rigidity that it helps to prevent the door 12 from buckling, bending, or otherwise deforming. In some embodiments, spot welding may be used to help mitigate or eliminate deformation of the curvature/shape of the door 12 during installation of the hinge 200.

In some embodiments, the mounting portion 204*b* of the rib member 204 is substantially C-shaped (see, e.g., FIGS. 2A-2B). As discussed in further detail below, when the hinge 200 of the present invention is installed on a monopole door 12, the shape of the mounting portion 204*b* allows the door 12 to pivot between the opened and closed position without making contact with the exterior surface 10*e* of the monopole 10 (see, e.g., FIGS. 7 and 8).

In some embodiments, the supporting portion 204*a* of the rib member 204 may comprise one or more protrusions 208. The protrusion(s) 208 extend outwardly from the side of the rib member 204 and are configured to be secured to the interior surface 12*i* of the door 12. In some embodiments, the protrusions 208 provide multiple points along the rib member 204 to mount (e.g., spot weld points WP) the hinge 200 to the door 12 (see also, e.g., FIG. 6A-6B). In combination with the accurate profile of the rib member 204, the protrusions 208 help to maintain the curvature/shape of the door 12 when the hinge 200 is being installed.

As shown in FIG. 4, the monopole door hinge assembly 100 of the present invention may comprise two or more hinges 200. When secured to the interior surface 12*i* of the door 12, the hinges 200 are separated a sufficient distance D apart to support the weight of the door 12. For example, in some embodiments, the hinges 200 may be separated a distance D in a range of about 1 inch to about 20 inches or more depending on the size of the door 12.

Figure 5:
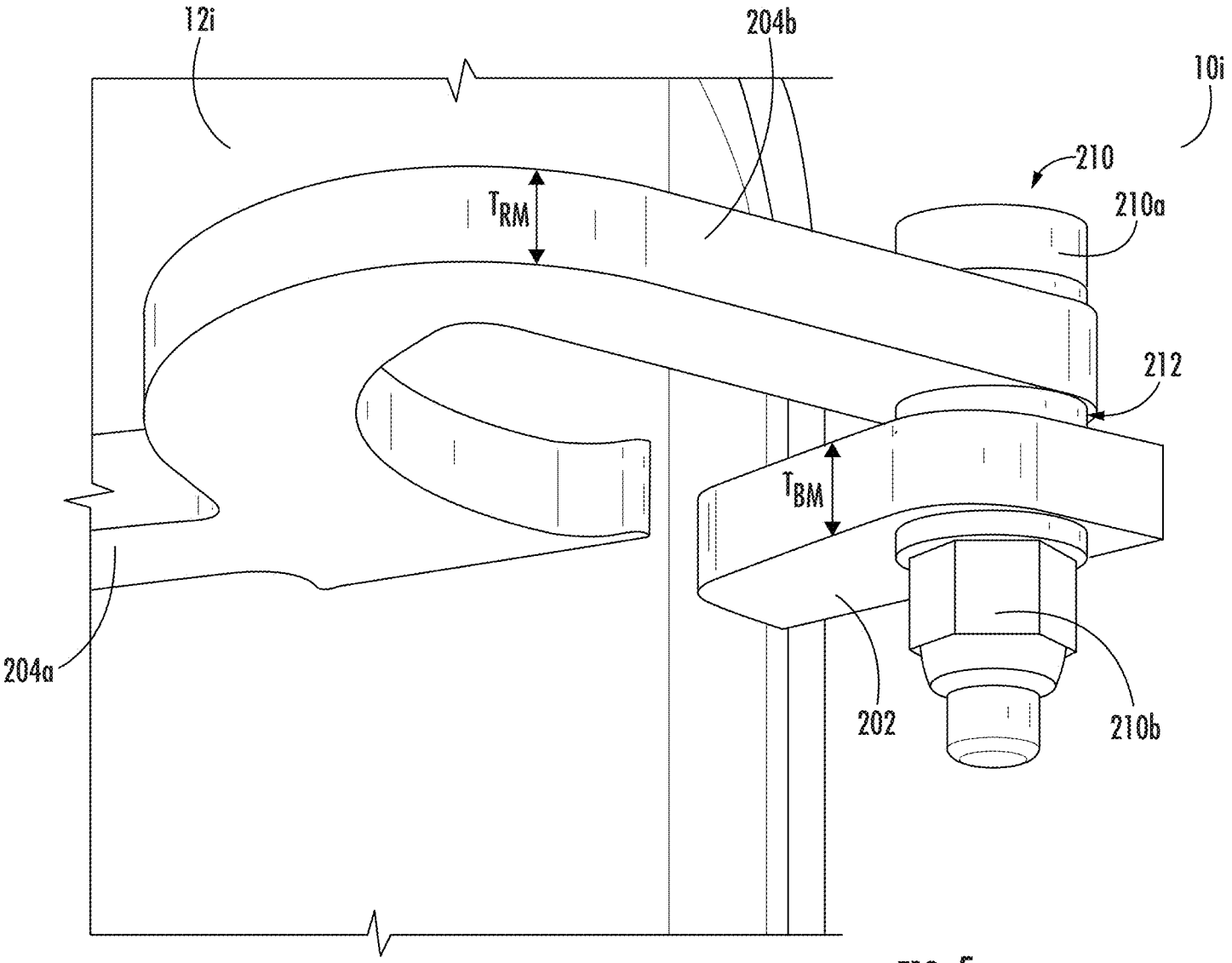
FIG. 5 is an enlarged bottom perspective view of a hinge base of the hinge of FIG. 3A.
Figure 6A:
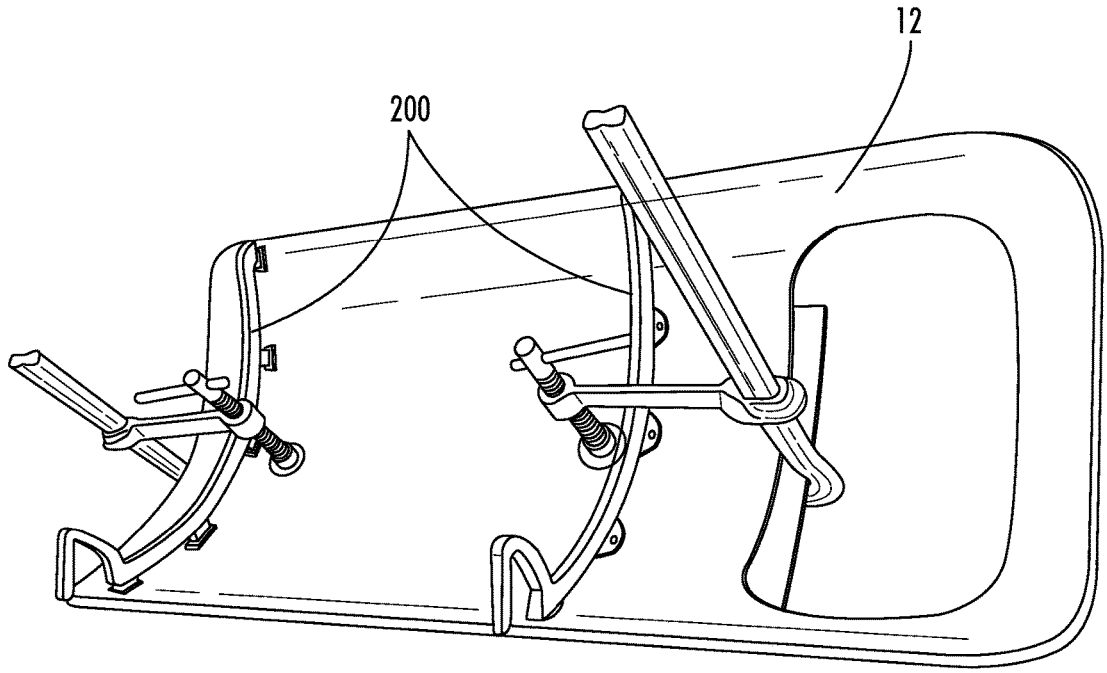
FIG. 6A and FIG. 6B are photographs showing an example method of installing the hinges to a monopole door according to embodiments of the present invention.
Figure 6B:
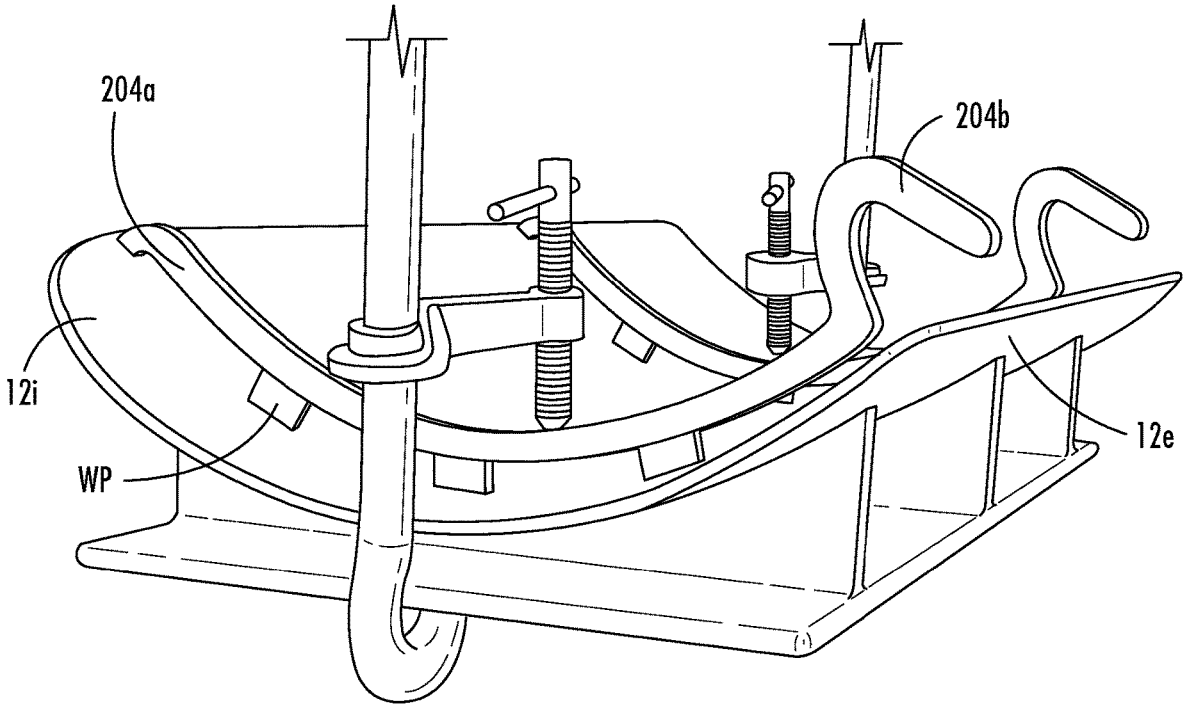

Referring to FIG. 5, the mounting portion 204*b* of the rib member 204 of the hinge 200 is configured to be secured to the base member 202. In some embodiments, the rib member 204 is pivotably attached to the base member 202 which allows the door 12 of the monopole 10 to pivot between an opened position and a closed position (see also, e.g., FIG. 7 and FIG. 8).

To secure the rim member 204 to the base member 202, the mounting portion 204*b* and the base member 202 may both comprise an aperture 205 (see, e.g., FIG. 3A). Each aperture 205 is substantially the same size and configured to receive a pivot member 210 when aligned. As shown in FIG. 5, in some embodiments, the pivot member 210 may comprise a threaded bolt 210*a* and nut 210*b*. In some embodiments, the pivot member 210 may further comprise a washer 212 placed between the mounting portion 204*b* of the rim member 204 and the base member 202 (see, e.g., FIG. 5). In some embodiments, the washer 212 is formed of a polymeric material. For example, in some embodiments, the washer 212 may be formed from polycarbonate or like material. Placing the washer 212 between the rim member 204 and the base member 202 of the hinge 200 may help to mitigate or eliminate damage to the outer finish of the monopole 10 (e.g., that may occur when two metallic pieces rub against each other).

In some embodiments, the monopole door hinge assembly 100 of the present invention may comprise the base member 202 of each hinge 200 being mounted (e.g., via welding) to the interior surface 10*i* of the monopole 10, the supporting portion 204*a* of each hinge 200 being mounted (e.g., via welding) to the interior surface 12*i* of the door 12, and the mounting portion 204*b* of each hinge 200 being pivotably attached (e.g., via bolt and nut) to a respective base member 202 of each hinge 200, thereby securing the door 12 to the monopole 10.

As discussed above, the plurality of hinges 200 is configured to support the weight of the door 12 of a monopole 10, in particular, when the door 12 is in an opened position. For example, in some embodiments, the plurality of hinges 200 is configured to support a door 12 of a monopole 10 having a weight in the range of about 1 pound to about 30 pounds or more depending on the size of the door 12.

Figure 7:
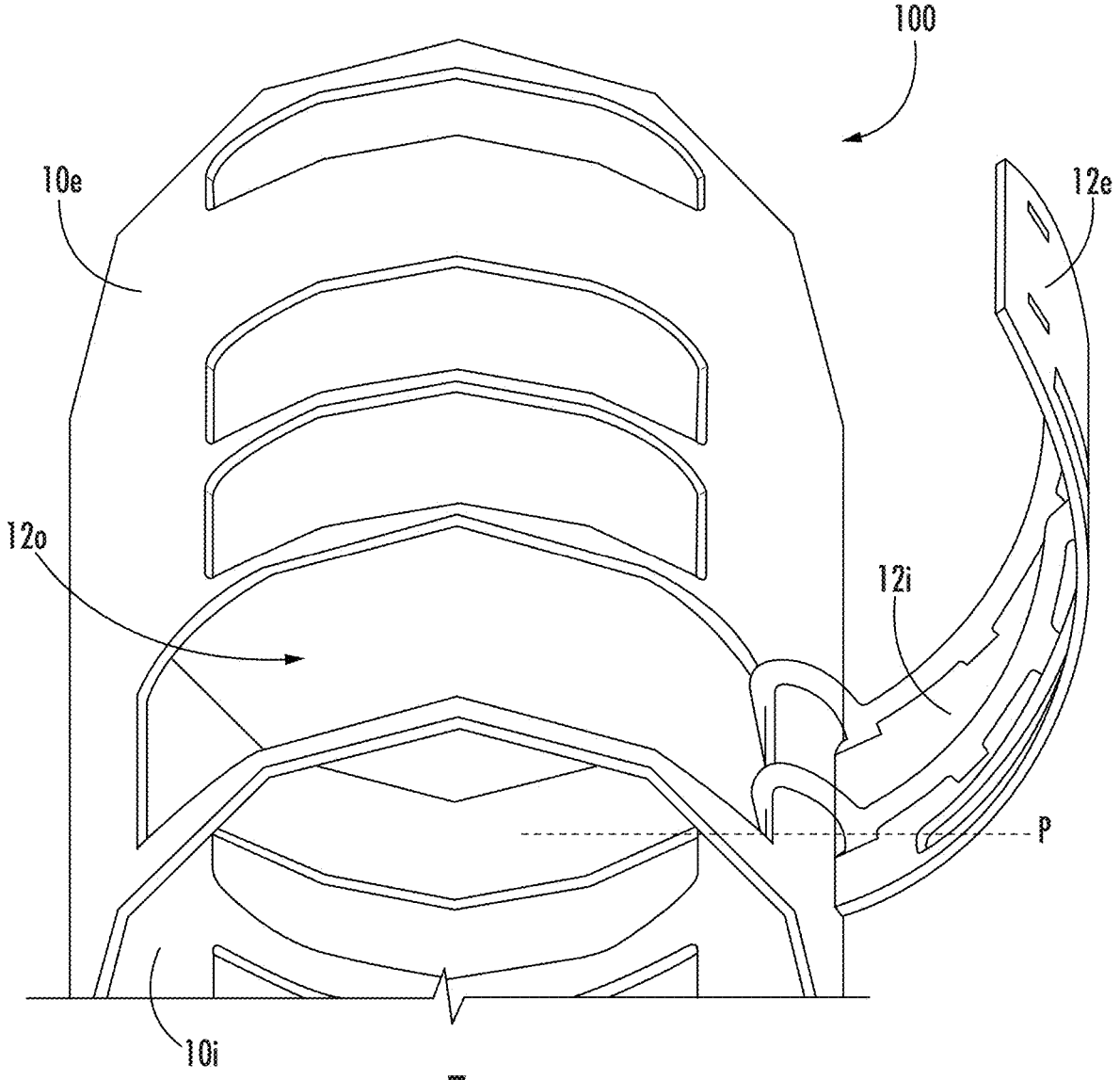
FIG. 7 is a top perspective view of the hinges of FIG. 2 supporting a monopole door in the open position.
Figure 8:
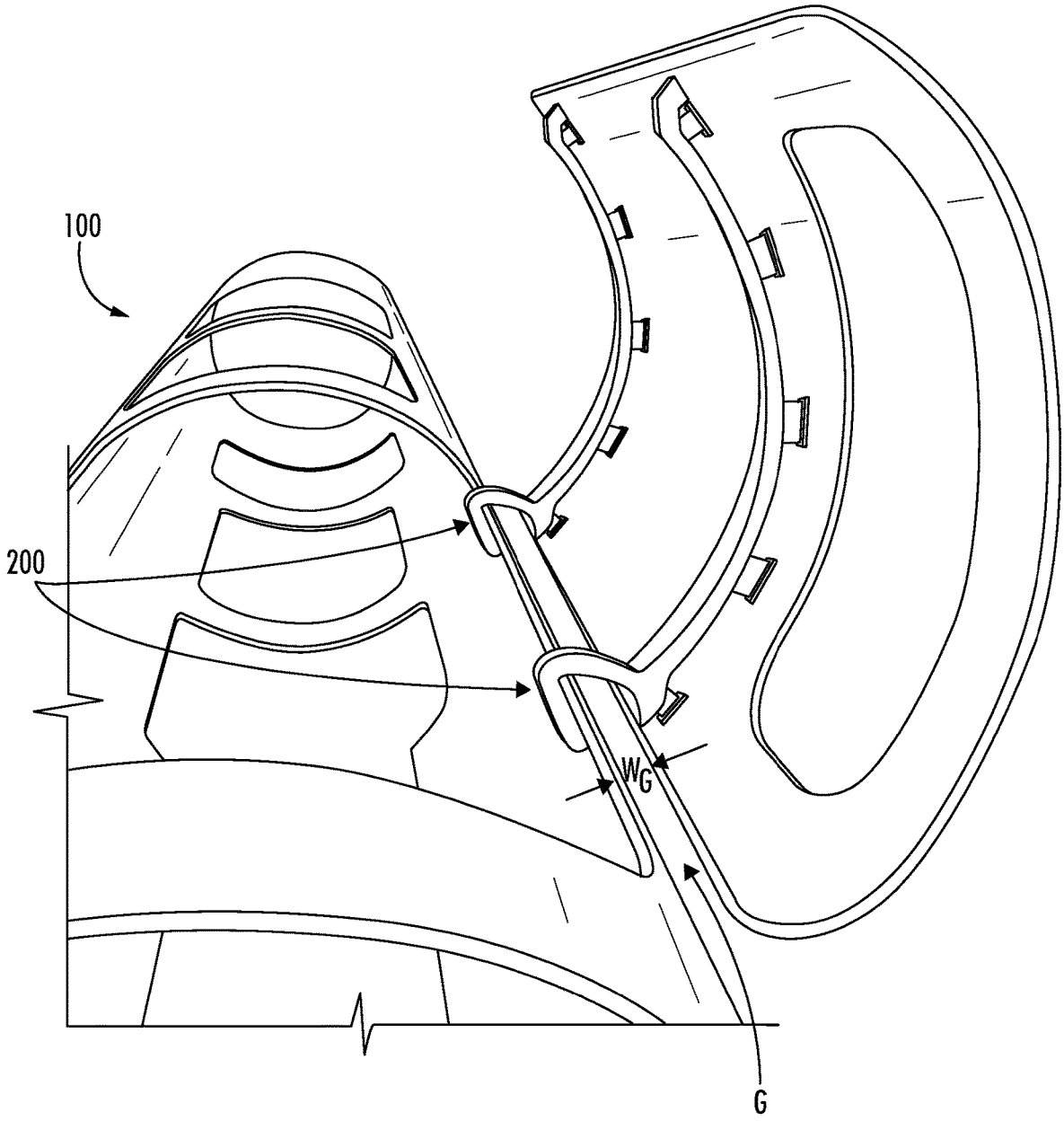
FIG. 8 is a photograph of the hinges of FIG. 7 supporting a monopole door.

Referring now to FIGS. 7 and 8, in some embodiments, the assembly 100 of the present invention may be configured such that the door 12 will not make contact with the exterior surface 10*e* of the monopole 10 when the door 12 swings from an opened position to a close position and vice versa. In some embodiments, the shape of the mounting portion 204*b* of the rim member 204 allows the door 12 to pivot without making contact with the exterior surface 10*e* of the monopole 10, thereby further helping to prevent the door 12 from chipping the outer coating (or finish) of the monopole 10.

As shown in FIG. 7, the shape of the mounting portion 204*b* may also allow a side edge of the door 12 to be opened past a longitudinal plane P defined by the door opening 12*o*. In some embodiments, the monopole door hinge assembly 100 of the present invention may allow the door 12 of the monopole 10 to be opened wider than allowed by current hinge assemblies, thereby providing a technician with more room to service the internal components of the monopole 10.

As shown in FIG. 8, when the door 12 is completely opened, the shape of the mounting portion 204*b* of the hinges 200 allows for a gap G between the door 12 and the exterior surface 10*e* of the monopole 10. In some embodiments, the width $W_G$ of the gap G is approximately equal to the width $W_{MP}$ of the opening of the mounting portion 204*b*. For example, in some embodiments, the width $W_G$ of the gap G between the door 12 and the exterior surface 10*e* of the monopole 10 is in the range of about 0.25 inches to about 1 inch. For example, in some embodiments, the width $W_G$ of the gap G between the door 12 and the exterior surface 10*e* of the monopole 10 is about 0.5 inches. In some embodiments, the door 12 may be opened until a section of the mounting portion 204*b* adjacent the pivot member 210 makes contact with the interior surface 10*i* of the monopole 10. When the mounting portion 204*b* contacts the interior surface 10*i*, the mounting portion 204*b* acts like a lever against the interior surface 10*i* of the monopole 10 to help support the weight of the door 12.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A monopole door hinge assembly, comprising:

a monopole comprising a door, the monopole and door both having an interior surface; and a plurality of hinges, each hinge comprising:

a base member configured to be secured to the interior surface of the monopole; and a rib member having a supporting portion and a mounting portion, the supporting portion having an arcuate profile that corresponds to an arcuate profile of the interior surface of the door and the mounting portion is pivotably attached to the base member;

wherein the base member of each hinge is mounted to the interior surface of the monopole and the supporting portion of each hinge is mounted to the interior surface of the door, thereby securing the door to the monopole, wherein the mounting portion of each hinge is positioned to allow the door to pivot between an opened position and a closed position without contacting an exterior surface of the monopole.

2. The monopole door hinge assembly of claim 1, wherein the plurality of hinges is configured to support the weight of the door when the door is in an opened position.

3. The monopole door hinge assembly of claim 1, wherein the plurality of hinges is configured to support a door having a weight in the range of about 1 pound to about 30 pounds.

4. The monopole door hinge assembly of claim 1, wherein the door has a width and the supporting portion of the rib member has a length that extends substantially the width of the door.

5. The monopole door hinge assembly of claim 1, wherein the supporting portion of the rib member has a length in the range of about 8 inches to about 14 inches.

6. The monopole door hinge assembly of claim 1, wherein the arcuate profile of the supporting portion of the rib member eliminates deformation of the interior surface of the door when the hinge is welded to the door.

7. A hinge for a door of a monopole, comprising:

a base member configured to be secured to an interior surface of the monopole; and a rib member having a supporting portion and a mounting portion, the supporting portion having an arcuate profile that corresponds to an arcuate profile of an interior surface of the door of the monopole and comprising one or more protrusions extending outwardly therefrom and the mounting portion having a substantially C-shaped profile is pivotably attached to the base member, wherein the one or more protrusions are positioned along the supporting portion of the rib member such that the arcuate profile of the door is maintained when the hinge is being secured to the interior surface of the door.

8. The hinge of claim 7, wherein the supporting portion of the rib member is mounted to an interior surface of the door of the monopole by welding.

9. The hinge of claim 8, wherein the arcuate profile of the supporting portion of the rib member eliminates deformation of the door when the hinge is welded to the door.

10. The hinge of claim 7, wherein the base member is mounted to the interior surface of the monopole by welding.

11. The hinge of claim 7, wherein the mounting portion is pivotably attached to the base member by a threaded bolt, nut and polymeric washer.

12. The hinge of claim 11, wherein the washer comprises polycarbonate.

13. The hinge of claim 7, wherein the mounting portion of the rib member is pivotably attached to the base member.

14. The hinge of claim 7, wherein the hinge is configured to support the weight of the door of the monopole when the door is in an opened position.

15. The hinge of claim 7, wherein the supporting portion of the rib member has a length in the range of about 8 inches to about 14 inches.

16. A monopole door hinge assembly, comprising:

a monopole comprising a door, the monopole and door both having an interior surface; and a plurality of hinges, each hinge comprising:

a base member configured to be secured to the interior surface of the monopole; and a rib member having a supporting portion and a mounting portion, the supporting portion having an arcuate profile that corresponds to an arcuate profile of the interior surface of the door and the mounting portion is pivotably attached to the base member;

wherein the base member of each hinge is mounted to the interior surface of the monopole and the supporting portion of each hinge is mounted to the interior surface of the door, thereby securing the door to the monopole, and wherein, when the door is in a completely open position, the shape of the mounting portion of each hinge allows for a gap between the door and an exterior surface of the monopole.

* * * * *